United States Patent [19]

Matsuo

[11] Patent Number: 4,989,046

[45] Date of Patent: Jan. 29, 1991

[54] APPARATUS FOR FORMING COLOR IMAGES

[75] Inventor: Hiroshi Matsuo, Nara, Japan

[73] Assignee: Sharp Kabushiki Kaisha, Osaka, Japan

[21] Appl. No.: 389,763

[22] Filed: Aug. 4, 1989

Related U.S. Application Data

[62] Division of Ser. No. 61,887, Jun. 12, 1987, abandoned.

[30] Foreign Application Priority Data

| | | | |
|---|---|---|---|
| Jun. 27, 1986 | [JP] | Japan | 61-151971 |
| Jun. 27, 1986 | [JP] | Japan | 61-151972 |
| Jun. 27, 1986 | [JP] | Japan | 61-151973 |
| Jun. 27, 1986 | [JP] | Japan | 61-151974 |
| Jun. 27, 1986 | [JP] | Japan | 61-151976 |

[51] Int. Cl.[5] ..... G03G 15/08

[52] U.S. Cl. ..... 355/279; 355/311

[58] Field of Search ..... 355/271, 311, 90, 100, 355/101, 111, 27, 28, 32, 279, 277; 430/138

[56] References Cited

U.S. PATENT DOCUMENTS

| | | | |
|---|---|---|---|
| 3,347,696 | 10/1967 | Newman | 430/254 |
| 3,695,912 | 10/1972 | DeLaurentis et al. | 156/234 |
| 3,736,138 | 5/1973 | Held | 430/254 |
| 3,898,086 | 8/1975 | Franer et al. | 430/254 |
| 3,975,563 | 8/1976 | Franer et al. | 430/5 |
| 4,388,137 | 6/1983 | McCarty et al. | 156/234 |
| 4,692,395 | 9/1987 | Findlay | 430/254 |
| 4,877,710 | 10/1989 | Ishikawa | 430/138 |

*Primary Examiner*—L. T. Hix
*Assistant Examiner*—Khanh Dang
*Attorney, Agent, or Firm*—Flehr, Hohbach, Test, Albritton & Herbert

[57] ABSTRACT

An image forming apparatus stores copy sheets and developer sheets in separate cassettes, picks up one sheet each from these cassettes, stack them one on top of the other and delivers the stacked sheets together to an image transfer device. One surface of the developer sheet is covered with a thermally fusible adhesive development layer. The image transfer device applies heat, pressure or both to the stacked sheets such that selected portions of the development layer stick to the copy sheet.

5 Claims, 13 Drawing Sheets

APPARATUS FOR FORMING COLOR IMAGES

This is a divisional of application Serial No. 061,887 filed June 12, 1987, now abandoned.

BACKGROUND OF THE INVENTION

This invention relates to an apparatus such as a color image copier for forming color images. More particularly, this invention relates to an apparatus such as a copier for forming images of different colors in various controlled manners by feeding a copy sheet and a developer sheet one on top of the other.

Toner is usually used as the developer by a copier and the like for forming an image on the image receiving medium such as a copy paper sheet. The toner is usually a mixture of a resin material which becomes soft and melt when heated to a relatively low temperature and a dye or a pigment as a coloring agent such that not only black but also blue and red images can be formed. If it is desired to form an image in a metallic color such as gold or silver, however, the toner must be mixed with a metal, and if a metal is mixed with a toner, the electrostatic image formed on the surface of the photosensitive drum begins to run such that the quality of the image is significantly affected adversely. For this reason, images in metallic colors such as gold and silver have been considered impossible to obtain. It is therefore an object of the present invention to provide a simple apparatus for forming images in specified colors such as gold and silver.

In another aspect, the present invention relates to a copier and the like for forming a horizontally inverted image such that the left-hand side and the right-hand side of the original to be copied are inverted on the formed image. In order to obtain such an inverted image by using a copier of the like, methods have been proposed previously whereby the optical system inside the copier is manipulated such that the light beams incident on the photosensitive body are inverted. Methods of this type, however, are not practical because a complicated optical system would be required and the increase in the cost of the apparatus may be considered unreasonably high since inverted images are not required very frequently. It is therefore another object of the present invention to provide a simple apparatus for obtaining an inverted image without restructuring the optical system or the like inside the copier. In still another aspect, the present invention relates to an apparatus for simultaneously producing a plurality of images from a single sheet of original. Conventional methods of simultaneously producing more than one copy were represented by the so-called impact process such as the dot impact method and daisy wheel method whereby a plurality of carbon sheets or the like are superposed and instantaneous pressures are applied to them simultaneously. Thus, it has been considered impossible to produce two or more copies simultaneously by a copier or other image forming means such as laser printers and liquid crystal printers which do not rely on the impact process. It is therefore a further object of the present invention to provide a copier and the like for simultaneously producing a plurality of images from a single original.

In a still further aspect, the present invention relates to a copier and the like for obtaining a copy in which the colored and uncolored sections of an original are reversed. According to a method previously considered for this purpose, the electrostatic latent image formed on the surface of the photosensitive drum was inverted, but a complicated mechanism is required for inverting a latent image and the apparatus becomes expensive to manufacture. It is therefore a still further object of the present invention to provide a simple apparatus for obtaining an image with colored and uncolored sections of an original inverted without restructuring the interior of a copier or the like.

SUMMARY OF THE INVENTION

According to the present invention, toner is attached to a developer sheet which is comprised of a color development layer covering a base sheet, the developer sheet is laid over a copy paper sheet, heat and/or pressure is applied to them and the copy paper sheet is thereafter peeled off the base sheet. Since the areas on the developer sheet where toner is attached have not only an increased thermal capacity but also an increased thickness, the color development layer corresponding to the areas where toner is attached becomes attached to the copy sheet by the heating and/or the applied pressure. If the copy sheet is peeled off the base sheet thereafter, a color development layer remains attached on the copy sheet in the same design as that of the toner image formed on the developer sheet. In summary, the color of the image to be formed is determined by that of the color development layer covering the base sheet. Thus, even if a metal is mixed into the color development layer, the surface of the photosensitive drum is not affected and an image of high quality can be obtained.

The object of the present invention for obtaining a horizontally inverted image is achieved by placing a copy sheet with toner attached thereon on top of a developer sheet having a color development layer covering a base sheet and removing the base sheet from the copy sheet after heat and/or pressure is applied to the developer sheet and the copy sheet. Since the areas on the copy sheet where toner is attached have not only an increased thermal capacity but also an increased thickness, the color development layer corresponding to the areas where toner is attached becomes attached to the copy sheet by the heating and/or the applied pressure. If the base sheet is peeled off the copy paper thereafter, a color development layer sticks to the lower surface of the copy sheet, showing the same design as that of the toner image formed on the upper surface of the copy sheet. Thus, one has only to turn this sheet upside down to obtain an image with the left-hand side and the right-hand side reversed with respect to each other without requiring a complicated apparatus.

The object of the present invention related to simultaneously obtaining a plurality of images is achieved by forming a multiple developer layer with a plurality of developer sheets of the type described above piled one on top of another. After this multiple developer layer is place on top of a copy sheet and heat and/or pressure is applied to them, the copy sheet and the base sheets of the individual developer sheets are removed. According to this invention, the areas on the multiple developer layer where toner is attached have not only an increased thermal capacity but also an increased thickness. Thus, if heat and/or pressure is applied to a copy sheet and this multiple developer layer, the parts of the color development layers corresponding to them become attached to the associated base sheets and to the copy sheet. If the base sheets and the copy sheet are peeled apart thereafter, one obtains color development layers of the same design on the base sheets and the copy sheet as that of the toner image formed on the multiple developer layer. In summary, a plurality of sheets with the same image can be obtained simultaneously.

To produce an image with colored and uncolored areas of an original inverted, toner is attached onto a developer sheet comprised of a color development layer covering a base sheet, a copy sheet is placed under this developer sheet, heat and/or pressure is applied to both the first copy sheet and the developer sheet, the copy sheet is thereafter peeled off the base sheet, a second copy sheet is placed under the base sheet, heat and/or pressure is applied to both the second copy sheet and the base sheet and the second copy sheet is thereafter peeled off the base sheet. As explained above, the areas of the developer sheet where toner is attached have not only an increased thermal capacity but also an increased thickness. Thus, if a copy sheet and such a developer sheet are heated and/or pressed together, the color development layer corresponding to the areas where toner is attached sticks to the copy sheet placed underneath. When the first copy sheet is removed from the base sheet in the process described above, a color image of the same design as the toner image appears on the first copy sheet. In other words, the lower surface of the base sheet is left with the color development layer where the toner image was not present. When the second copy sheet is placed thereunder and heated and/or pressed with the base sheet in this condition, the color development layer on the base sheet is transferred to the second copy sheet. Thus, the second copy sheet, when peeled off the base sheet, is found to carry an image with the colored and uncolored sections of the original reversed with respect to each other.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIGS. 7A through 7D are schematic sectional views showing the steps by which the developer sheet of FIG. 4 is processed according to another method embodying the present invention.

DETAILED DESCRIPTION OF THE INVENTION

Figure 1:
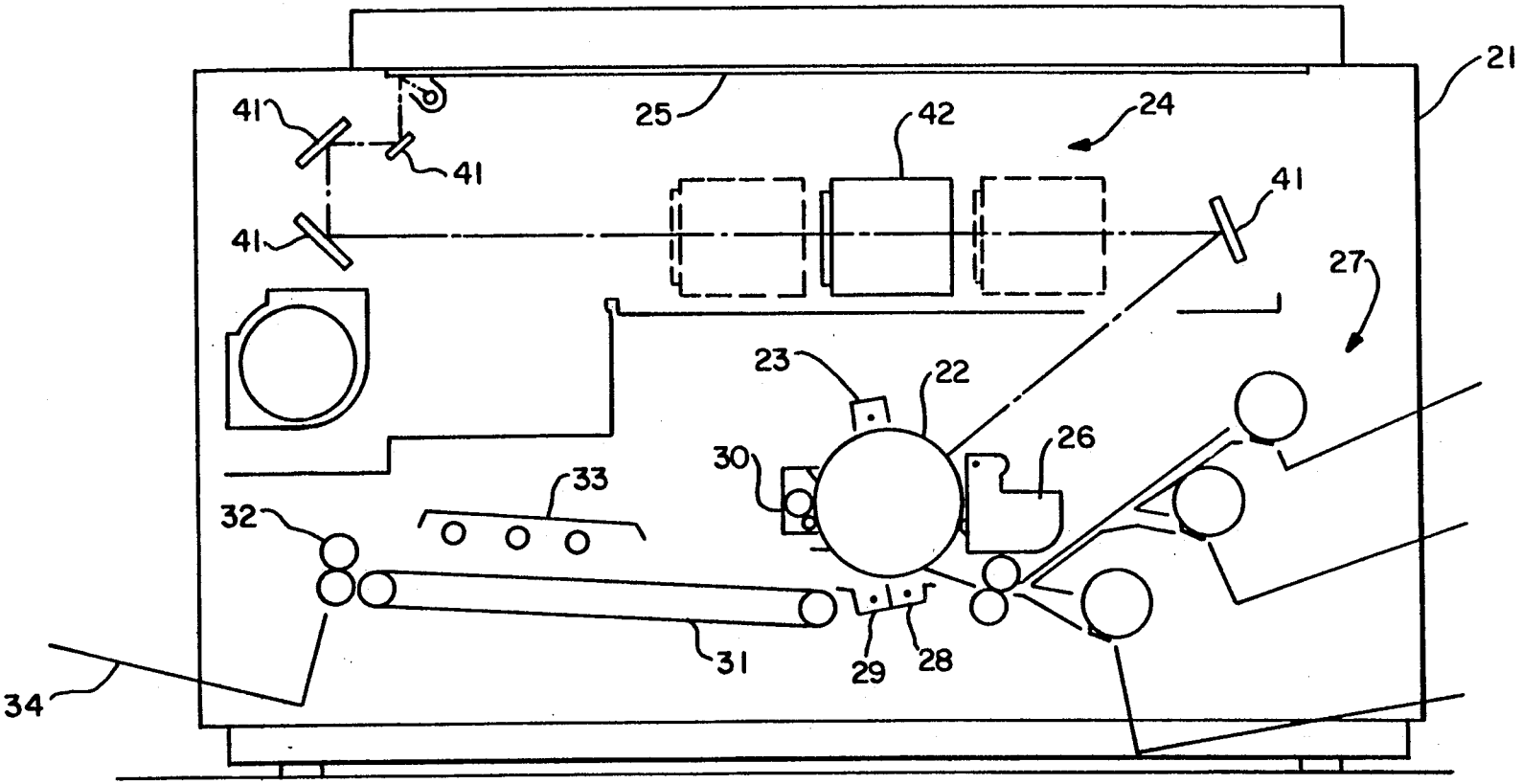
FIG. 1 is a schematic side sectional view showing the structure of a copier embodying the present invention.

FIG. 1 shows the structure of a copier 21 as an example of image forming apparatus with which methods of the present invention to be described below may be used. A photosensitive drum 22 of the type well known in the copier art is disposed nearly at the center of the copier 21 and is surrounded sequentially by a primary charger 23 for uniformly charging the surface of the photosensitive drum 22, a developing unit 26 for attaching toner on the surface of the photosensitive drum 22, a transfer charger 28 for transferring toner from the surface of the photosensitive drum 22 onto a copy paper sheet transported from a paper supplying section 27, a paper removing charger 29 for causing a copy sheet to peel off the surface of the photosensitive drum 22 and a cleaning unit 30 for cleaning the surface of the photosensitive drum 22. An optical unit 24 which includes mirrors 41 and a lens 42 is disposed above the photosensitive drum 22 so as to cause a light beam reflected from an original document placed on a document table 25 to be made incident on the surface of the photosensitive drum 22 immediately before the developing unit 26. A suction belt 31 is disposed behind the paper removing charger 29 and serves to transport a copy sheet which has been peeled off the surface of the photosensitive drum 22 to a fixing unit 32. A heater 33 is provided above the suction belt 31. Both the heater 33 and the fixing unit 32 are set to a predetermined level of temperature according to the type of developer sheet which will be used. A copy sheet which has been processed by the fixing unit 32 is discharged onto a discharge tray 34.

Figure 2:
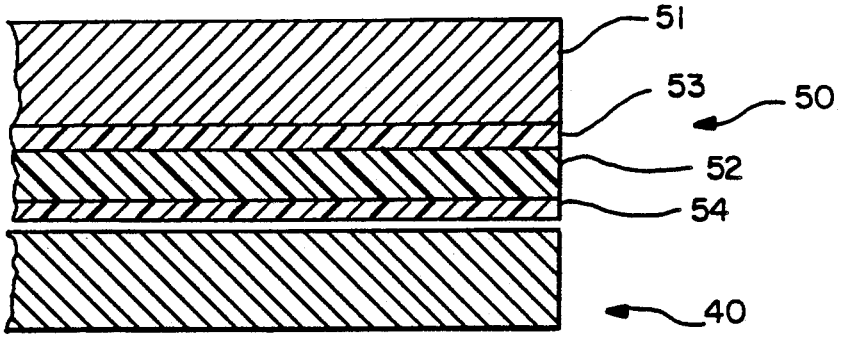
FIG. 2 is a schematic sectional view of a developer sheet embodying the present invention placed above a copy paper sheet.

FIG. 2 is a schematic sectional view of a developer sheet 50 embodying the present invention together with a copy sheet 40. The copy sheet 40 is of a known kind of thermal paper commonly used with conventional copiers and the like. The developer sheet 50 is a thermally fusible and adhesive sheet of a known type commonly used with a thermal printer and the like and is comprised of a color development layer 52 which may contain metallic powder and covers a base sheet 51 made of a copy paper sheet, a plastic film or the like. Between the base sheet 51 and the color development layer 52 is a separation layer 53 which makes it easier for the color development layer 52 to peel off the base sheet 51 and stick to the copy sheet 40 when the color development layer 52 is heated. Below the color development layer 52 is an adhesive layer 54 which makes it easier for the color development layer 52 to stick to whatever is in contact therewith when it is heated (the copy sheet 40 in the case of FIG. 2). The temperature of the heater 33 and the fixing unit 32 is set such that the color development layer 52 does not melt where no toner is attached to the surface of the developer sheet 50 but does melt where toner is attached and hence the thermal capacity is increased.

Figure 3A:
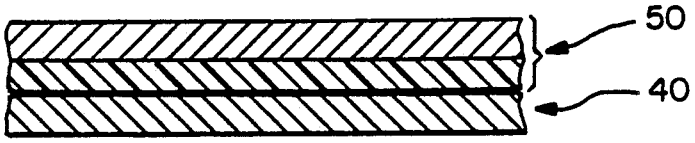
FIGS. 3A through 3D are schematic sectional views showing the steps by which the developer sheet of FIG. 2 is processed according to the present invention.
Figure 3B:
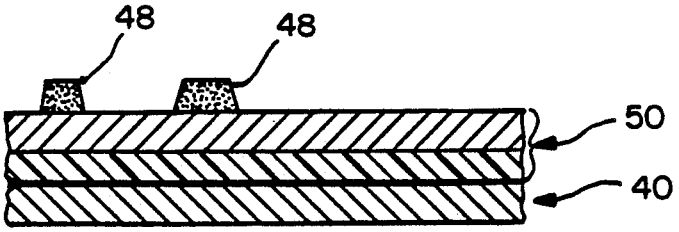

FIGS. 3A through 3D show the steps by which a developer sheet of the type described above is used with a copier as shown in FIG. 1 to form an image on a copy sheet except the separation layer 53 and the adhesive layer 54 are omitted for the sake of simplicity. The initial processes are the same as in the ordinary copier operation, that is, the surface of the photosensitive drum 22 is uniformally charged by the primary charger 23 and the reflected beam of light from the original on the document table 25 is focused by the optical unit 24 on the surface of the photosensitive drum 22. Toner is then attached by the developing unit 26 to the latent image formed on the photosensitive drum 22 by this exposure. Concurrently with these processes, a copy sheet 40 is transported in from the paper supplying section 27 with a developer sheet 50 superposed thereon as shown in FIG. 3A. In the next step, the transfer charger 28 causes the toner which has been on the surface of the photosensitive drum 22 to be transferred onto the developer sheet 50 as shown in FIG. 3B wherein numerals 48 indicate the toner stuck on the top surface of the developer sheet 50. Alternatively to the above, the copy sheet 40 may be transported in from the paper supply section 27 after toner 48 is deposited on the developer sheet 50.

Figure 3C:
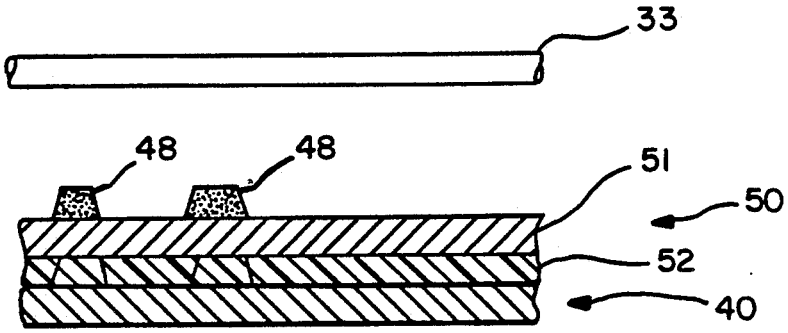

After the developer sheet 50 and the copy sheet 40 are separated together from the surface of the photosensitive drum 22 by an operation of the paper removing charger 29, they are transported to the fixing unit 32 by the suction belt 31. As they are thus transported, they are heated by the heater 33 disposed above the suction belt 31 as well as by the fixing unit 32 as disclosed, for example, in Japanese Patent Publication Tokkai 58-6877. As a result, since the portions of the developer sheet 50 covered by toner 48 are thicker and have a greater thermal capacity than the uncovered areas, the color development layer 52 corresponding to the covered portions melts and sticks to the copy sheet 40, aided by the adhesive layer 54 as shown in FIG. 3C.

Figure 3D:
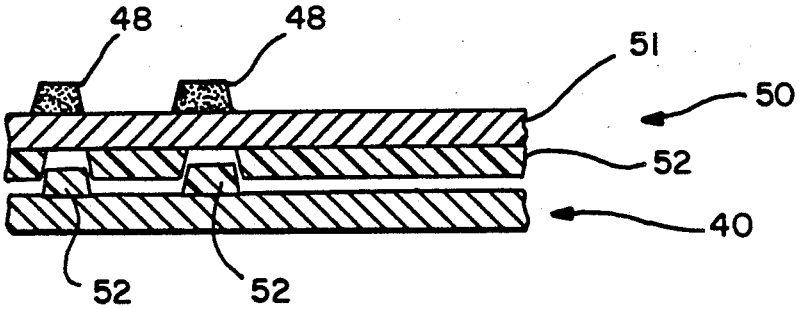

After the copy sheet 40 is discharged onto the discharge tray 34 together with the developer sheet 50, the base sheet 51 is peeled off the copy sheet 40 as shown in FIG. 3D. Since the melted portions of the color development layer 52 are more strongly stuck to the copy sheet 40 because of the adhesive layer 54 therebetween, the remaining parts of the color development layer 52 corresponding to the uncovered areas of the developer sheet 50 stay with the base sheet 51 and are removed from the copy sheet 40. What thus results is a copy of the original and since the color development layer 52 contains metallic powder, the image thus formed has a metallic color.

Figure 4:
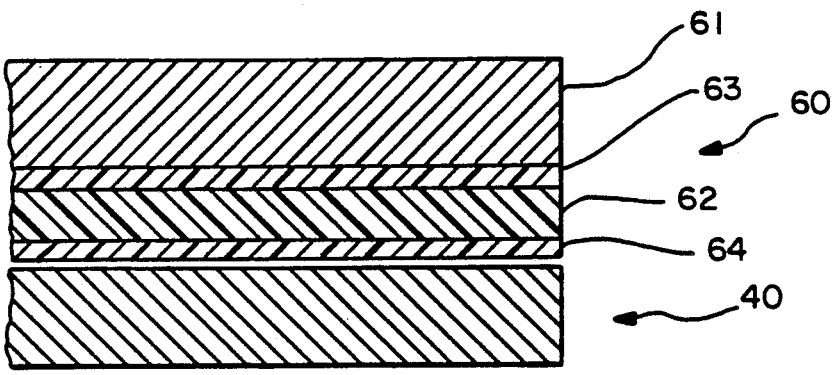
FIG. 4 is a schematic sectional view of another developer sheet embodying the present invention placed above a copy paper sheet.

FIG. 4 is a schematic sectional view of another kind of developer sheet 60 embodying the present invention, characterized as being adapted to be processed by pressure instead of heat. Numeral 40 in FIG. 4 again indicates a copy sheet of a known type. Like the developer sheet 50 described above and depicted in FIG. 2, the developer sheet 60 according to this embodiment also is comprised of a base sheet 61 and a color development layer 62 which may contain metallic powder, but the color development layer 62 forming a part of this developer sheet 60 is characterized as hardening by pressure, rather than by heat. Between the color development layer 62 and the base sheet 61 is a separation layer 63 which makes it easier for parts of the color development layer 62 hardened by pressure to separate from the base sheet 61. Under the color development layer 62 is an adhesive layer 64 which serves to cause the same parts of the color development layer 62 hardened by pressure to stick to whatever is in contact therewith (the copy sheet 40 in the case of FIG. 4).

To make a copy of an original, a copy sheet 40 is placed under a developing sheet 60 as shown in FIG. 4, and they are processed together by a copier of the type shown in FIG. 1 and by a series of steps as described above in connection with FIGS. 2 and 3. In the present case, however, there is no need for the heater 33 above the suction belt 31 and the fixing unit 32 has only to be heated to the normal temperature for an ordinary copier. It is necessary, however, to adjust the pressure between rollers of the fixing unit 32 according to the kind of developer sheet being used such that the color development layer 62 does not harden in areas where toner is not attached to the surface of the developer sheet 60 but it does harden where toner is attached such that the total thickness is increased and hence the pressure from the rollers is also increased.

Figure 5A:
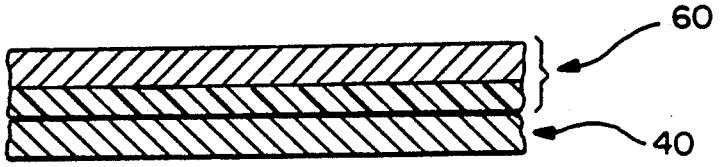
FIGS. 5A through 5D are schematic sectional views showing the steps by which the developer sheet of FIG. 4 is processed according to the present invention.
Figure 5B:
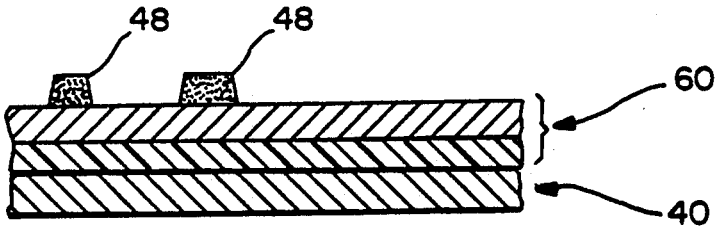
Figure 5C:
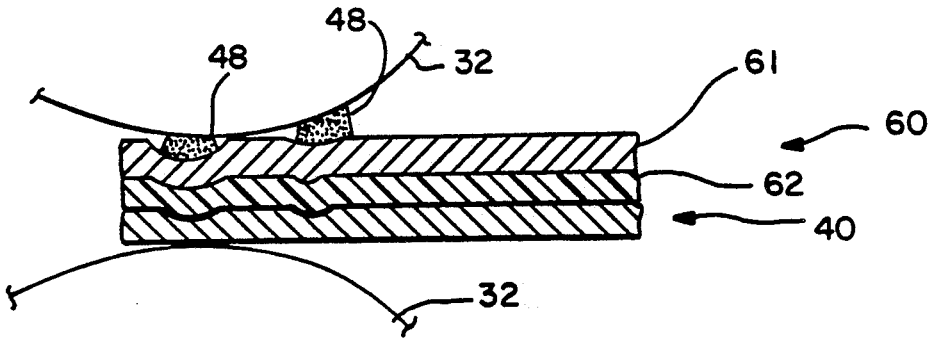
Figure 5D:
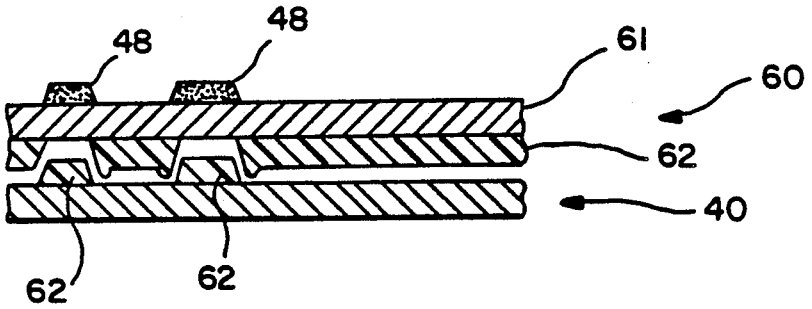

FIGS. 5A through 5D show the steps by which a developer sheet of the type described above by way of FIG. 4 is used with a copier shown in FIG. 1 to form an image on a copy sheet. For the sake of simplicity, the separation layer 63 and the adhesive layer 64 are again omitted from FIGS. 5A through 5D. As explained above by way of FIGS. 3A through 3D, a developer sheet 60 is placed above a copy sheet 40 and transported together as shown in FIG. 5A to be processed by the copier. Next, toner 48 is transferred from the surface of the photosensitive drum 22 by an operation of the transfer charger 28 onto the developer sheet 60 as shown in FIG. 5B and as explained above by way of FIG. 3B. When the developer sheet 60 and the copy sheet 40 thus processed are transported by the suction belt 33 to the fixing unit 32, they are pressed together as disclosed, for example, in Japanese Utility Model Publication Kikkai 58-31558, between the rollers of the fixing unit 32 as shown in FIG. 5C. Since the portions of the developer sheet 60 covered by toner 48 are thicker than the uncovered areas, the parts of the color development layer 62 corresponding to the thickened portions of the developer sheet 60 experience a greater pressure and become hardened. Since an adhesive layer 64 is provided between the color development layer 62 and the upper surface of the copy sheet 40, the hardened parts of the color development layer 62 are pressed against and hence stick to the copy sheet 40, producing an image on the copy sheet 40. The copy sheet 40 and the developer sheet 60, still compressed together, are discharged onto the discharge tray 34. The copy sheet 40 is thereafter peeled off the base sheet 61 as shown in FIG. 5D and as explained above in connection with FIG. 3D. An image of a metallic color such as gold or silver can thus be obtained on a copy sheet. It now goes without saying that images of any color, not necessarily metallic, can be produced by mixing a proper pigment in the color development layer 62.

The aforementioned object of the present invention related to producing a horizontally inverted image is achieved by using a developing sheet of the type described above and depicted in FIGS. 2 or 4. FIGS. 6A through 6D show the steps by which this object is achieved by using a developer sheet shown in FIG. 2 with a copier shown in FIG. 1. As done in FIGS. 3A through 3D, the separation layer 53 and the adhesive layer 54 are omitted in FIGS. 6A through 6D, and components which are identical or similar to those depicted in FIG. 2 and FIGS. 3A through 3D are indicated also by the same numerals.

Figure 6A:
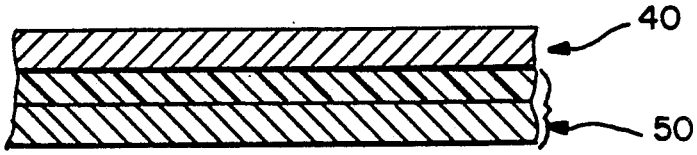
FIGS. 6A through 6D are schematic sectional views showing the steps by which the developer sheet of FIG. 2 is processed according to another method embodying the present invention.
Figure 6B:
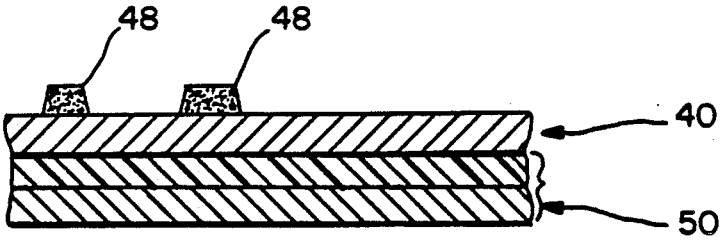
Figure 6C:
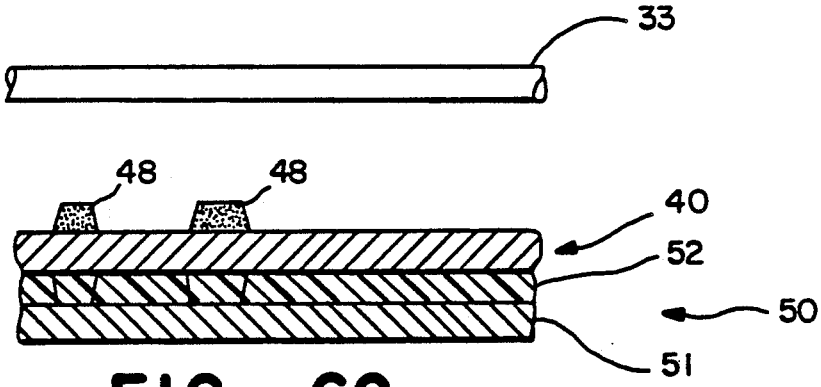
Figure 6D:
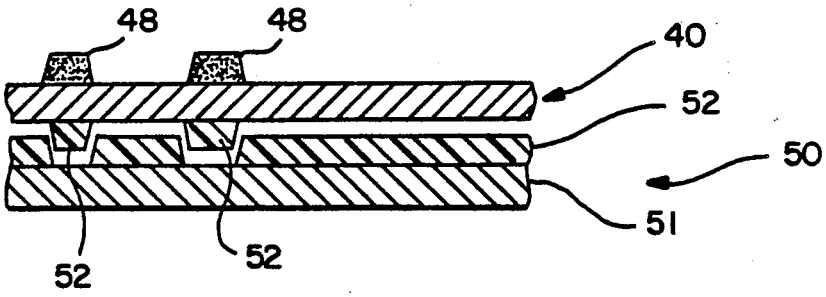

As shown in FIG. 6A, the developer sheet 50 is placed upside down compared to the manner in which it was positioned in the case of FIG. 3A and the copy sheet 40 is placed above, not below, the developer sheet 50, but again on the side of the developer sheet 50 with the adhesive layer 54. Next, toner 48 is transferred from the surface of the photosensitive drum 22 by an operation of the transfer charger 28 onto the upper surface of the copy sheet 40 as shown in FIG. 6B which should be compared with FIG. 3B for reference. Thereafter, the copy sheet 40 and the developer sheet 50 are removed from the surface of the photosensitive drum 22 by an operation of the paper removing charger 29 and transported to the fixing device 32 by the suction belt 31. As explained above in connection with FIGS. 3C and 3D, the copy sheet 40 and the developer sheet 50 are heated by the heater 33 and the fixing device 32, and the portions of the color development layer 52 in the developer sheet 50 corresponding to the areas covered by toner 48 are melted and stick to the copy sheet 40 as shown in FIG. 6C. When the base sheet 51 is peeled off the copy sheet 40 thereafter, an inverted image, as desired, is obtained on the lower surface of the copy sheet 40 as shown in FIG. 6D.

Figure 7A:
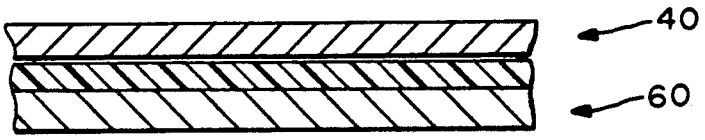
Figure 7B:
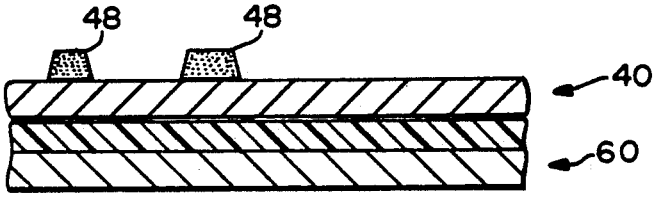
Figure 7C:
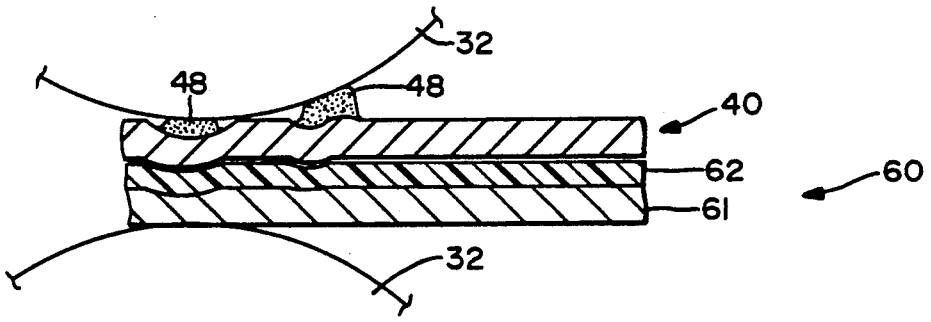
Figure 7C:
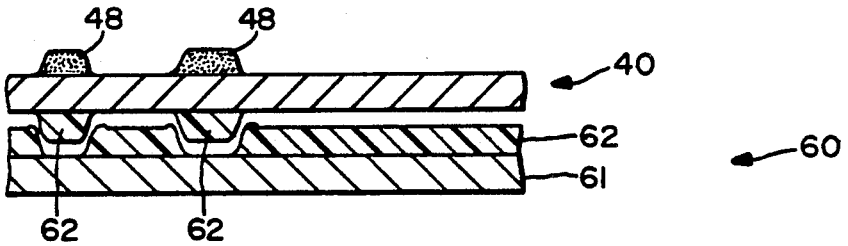

As the developer sheet 50 of FIG. 2 adapted to be processed by heating can be used upside down as shown in FIGS. 6A through 6D to obtain a horizontally inverted image, the developer sheet 60 for processing by pressure can also be used upside down to obtain a similar result as shown in FIGS. 7A through 7D wherein components which are identical or similar to those depicted in FIG. 4 and FIGS. 5A through 5D are indicated also by the same numerals and the separation layer 63 and the adhesive layer 64 are omitted for simplicity. Briefly explained, FIG. 7A shows the same developer sheet 60 of FIG. 4 placed upside down and a copy sheet 40 placed thereon as they are fed from the paper supplying section 27. FIG. 7B shows the same copy sheet 40 and developer sheet 60 with toner 48 transferred from the surface of the photosensitive drum 22 by an operation of the transfer charger 28. FIG. 7C shows still the same copy sheet 40 and developer sheet 60 as pressure is applied to them between the rollers of the fixing unit 32. FIG. 7D shows the result of the aforementioned pressing process, with portions of the color development layer 62 stuck to the copy paper 40 corresponding to the sections covered by toner 48. In summary, the developer sheets 50 and 60 can be used upside down, with a copy sheet placed thereabove and a horizontally inverted image can be easily obtained by a process similar to that for obtaining a regular image of a desired color explained above by way of FIGS. 1 through 5.

Figure 8:
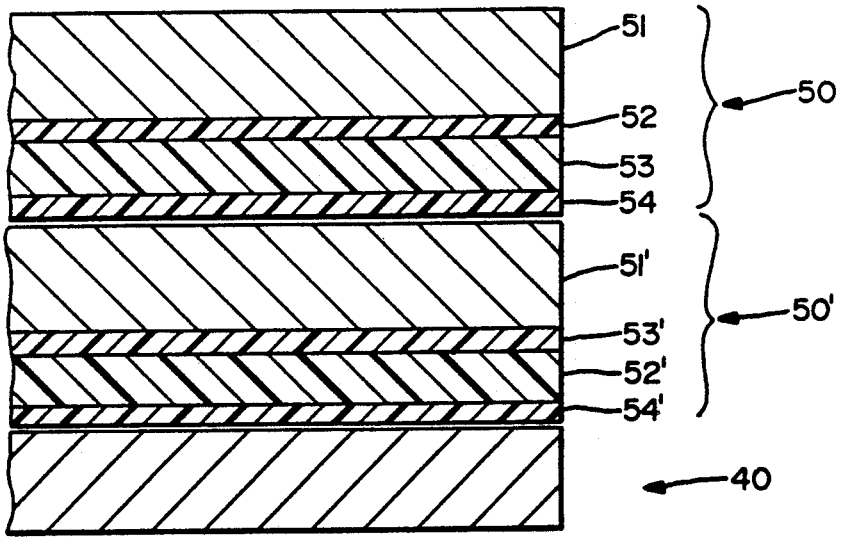
FIG. 8 is a schematic sectional view of a combination of two developer sheets shown in FIG. 2 for simultaneously producing two copies from a single original.

The object of the present invention related to simultaneously obtaining a plurality of copies from a single original is achieved by superposing a plurality of developer sheets of the type described above in connection with FIGS. 2 and 4. FIG. 8 shows, for example, two developer sheets 50 and 50' of the type shown in FIG. 2 one on top of the other. The combination is placed above a copy sheet 40 of an ordinary type and each of the developer sheets 50 and 50' comprises a base sheet 51 or 51', a separation layer 53 or 53', a color development layer 52 or 52' and an adhesive layer 54 or 54'. The base sheets 51 and 51' may comprise copy sheets of the same known kind. FIGS. 9A through 9D show how the combination of two developer sheets 50 and 50' shown in FIG. 8 is used with a copier of FIG. 1 to produce two copies of a single original simultaneously. For simplicity, the separation layers 53 and 53' and the adhesive layers 54 and 54' are omitted.

Figure 9A:
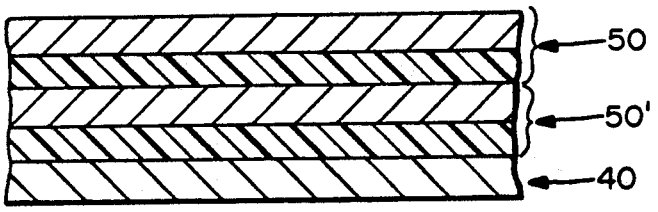
FIGS. 9A through 9D are schematic sectional views showing the steps by which the combination of FIG. 8 is processed according to the present invention to produce two copies simultaneously from a single original.
Figure 9B:
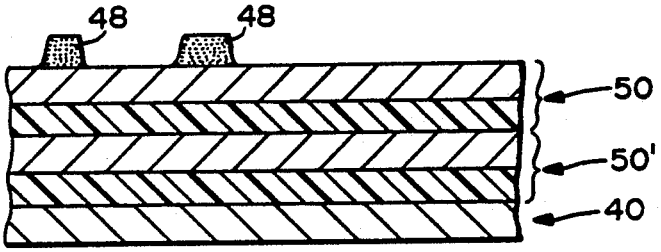
Figure 9C:
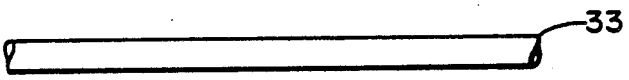
Figure 9C:
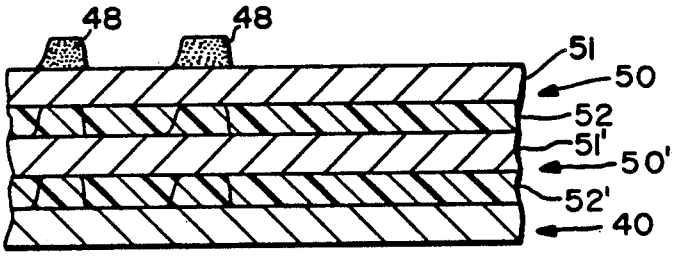
Figure 9D:
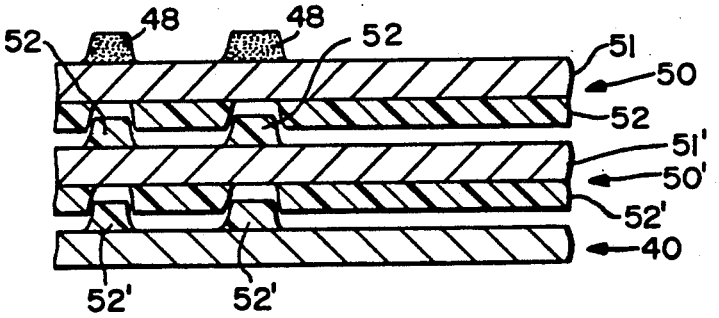

FIG. 9A shows how the combination is placed on top of a copy sheet 40 to be transported from the paper supply section 27. Toner 48 is thereafter transferred from the surface of the photosensitive drum 22 by an operation of the transfer charger 28 onto the top surface of the combination, that is, the upper surface of the base sheet 51 of the upper developer sheet 50 as shown in FIG. 9B. As the combination of the developer sheets 50 and 50' and the copy sheet 40 are heated, the portions of the color development layers 52 and 52' corresponding to the areas where toner 48 is deposited melt and stick to the base sheet 51' and the copy sheet 40, respectively, aided by the adhesive layers 54 and 54' as shown in FIG. 9C. Two copies of the original are obtained if the base sheets 51 and 51' are separated from each other and from the copy sheet 40 as shown in FIG. 9D.

Figure 10:
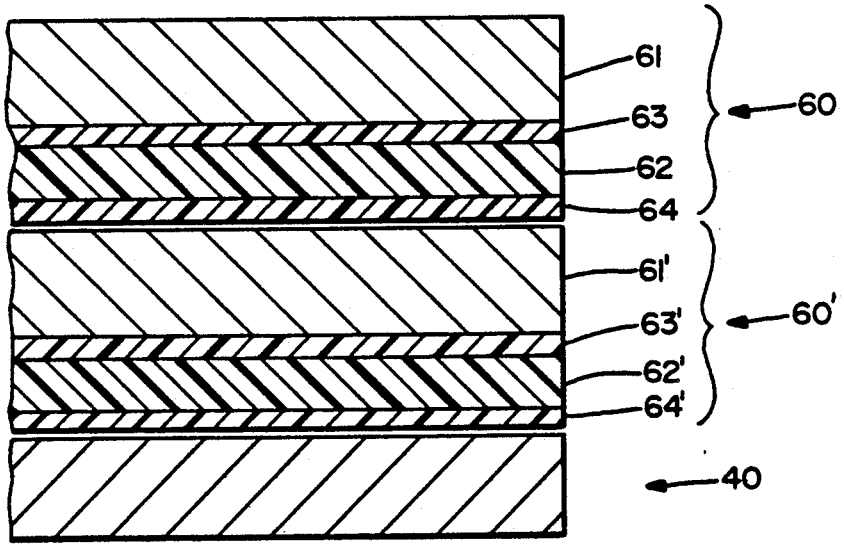
FIG. 10 is a schematic sectional view of a combination of two developer sheets shown in FIG. 4 for simultaneously producing two copies from a single original.

Likewise, a combination shown in FIG. 10 of two developer sheets 60 and 60' of the type shown in FIG. 4 can be used for the same purpose as described above except the step of heating in FIG. 9C is replaced by a step of applying pressure between the two rollers of the fixing unit 32 as explained above in connection with FIG. 5C with reference to the step depicted in FIG. 3C. Briefly explained, FIG. 10 shows a combination of two developer sheets 60 and 60' of the type shown in FIG. 4 piled one on top of the other, with a copy sheet 40 placed therebelow. The layers comprising the developer sheet 60 are indicated by the same numerals as in FIG. 4 and numerals 61', 62', 63' and 64' indicate layers of the developer sheet 60' which are respectively identical to the layers 61, 62, 63 and 64. The steps by which the combination of FIG. 10 is used with a copier of FIG. 1 to produce two copies simultaneously from a single original are shown in FIGs. 11A through 11D wherein the separation layers 63 and 63' and the adhesive layers 64 and 64' are omitted for simplicity.

Figure 11A:
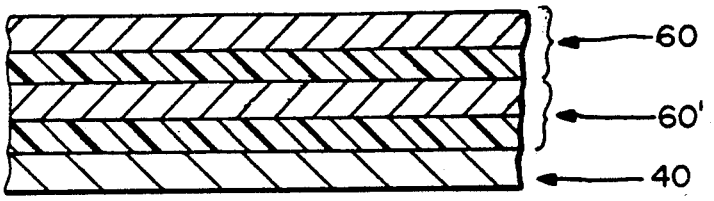
FIGs. 11A through 11D are schematic sectional views showing the steps by which the combination of FIG. 10 is processed according to the present invention to produce two copies simultaneously from a single original, FIGs. 12/A through 12D are schematic sectional views showing the steps by which the developer sheet processed as shown in FIGS. 3A through 3D can be further processed for obtaining a copy with colored and uncolored parts of the original inverted with respect to each other.
Figure 11B:
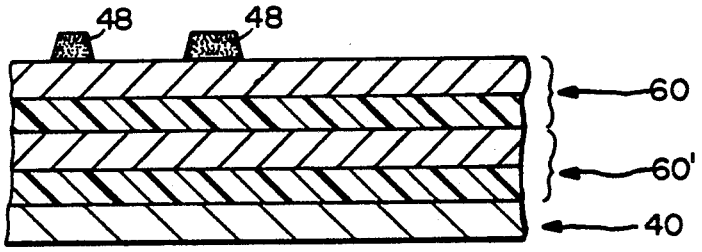
Figure 11C:
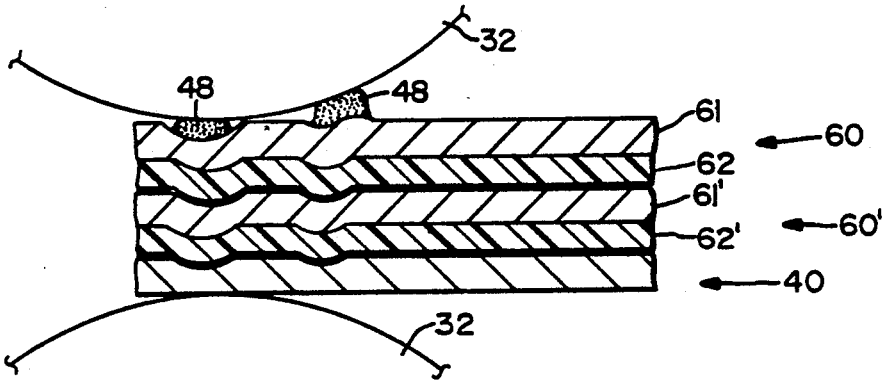
Figure 11D:
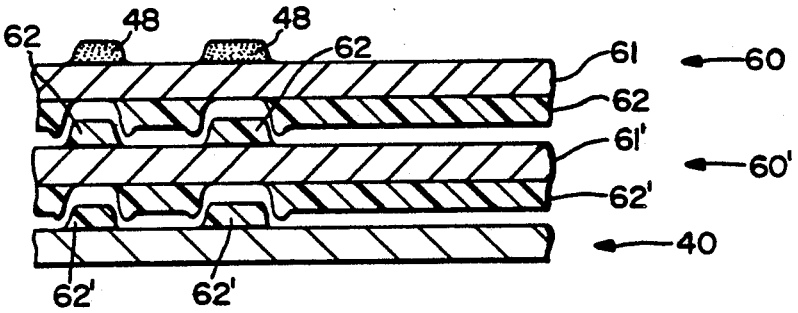

FIG. 11A shows how the combination is placed on top of a copy sheet 40 to be transported from the paper supplying section 27. Toner 48 is thereafter transferred from the surface of the photosensitive drum 22 by an operation of the transfer charger 28 onto the top surface of the combination as shown in FIG. 11B and explained in connection with FIG. 9B. The combination thus processed is thereafter removed from the surface of the photosensitive drum 22 and passed between the rollers of the fixing unit 32. This causes the portions of the color development layers 62 and 62 corresponding to the areas on the top surface covered by toner 48 to harden and to stick to the base sheet 61' and the copy sheet 40, respectively, as shown in FIG. 11C and, when the base sheets 61 sand 61' and the copy sheet 40 are separated from one another, two copies of the original are obtained as shown in FIG. 11D.

Figure 12A:
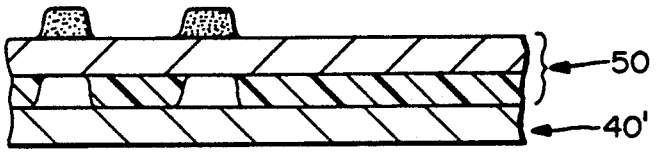
Figure 12B:
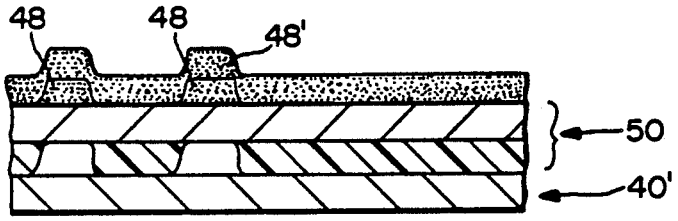
Figure 12C:
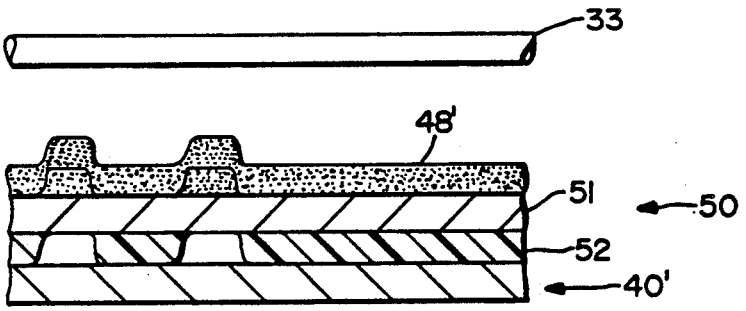
Figure 12D:
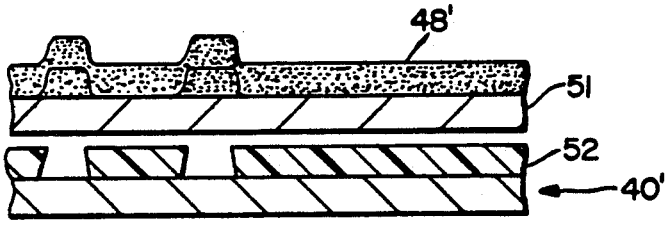

Developer sheets of the types shown in FIGS. 2 and 4 can also be used to achieve the aforementioned object of the present invention related to producing an image with colored and uncolored sections of an original inverted with respect to each other. When the developer sheet 50 of FIG. 2 is to be used for this purpose, the processes explained by way of FIGS. 3A through 3D are initially carried out. Processes to be carried out thereafter are illustrated in FIGS. 12A through 12D wherein components corresponding to those in FIGS. 3A through 3D are indicated by the same numerals and, in particular, the separation layer 53 and the adhesive layer 54 shown in FIG. 2 are again omitted for simplicity. After the copy sheet 40 of FIG. 3D is removed, a second copy sheet 40' is placed under the developer sheet 50 of FIG. 3D as shown in FIG. 12A, and the copier is run for another cycle of copying operation with a sheet having a low reflectivity placed on the document table 25 as a new original such that toner is applied all over the base sheet 51 as shown in FIG. 12B to form a new toner layer 48'. As the developer or sheet 50 thus covered by a uniform toner layer 48' as well as the copy sheet 41' is subsequently removed from the surface of the photosensitive drum 22 by an operation of the paper removing charger 29 and transported to the fixing unit 32 by the suction belt 31, it becomes heated by the heater 33 and the fixing unit 32 as explained above by way of FIG. 3C, and the color development layer 52 below the base sheet 51 is melted because of the increase in thermal capacity caused by the toner layer 48' above the base sheet 51 and sticks to the copy sheet 40' as shown in FIG. 12C aided by the adhesive layer 54. After the developer sheet 50 and the copy sheet 40' are discharged onto the discharge tray 34, they are separated from each other as shown in FIG. 12D and one obtains on the copy sheet 40' an image of which colored and uncolored sections of the original are inverted with respect to each other.

Figure 13A:
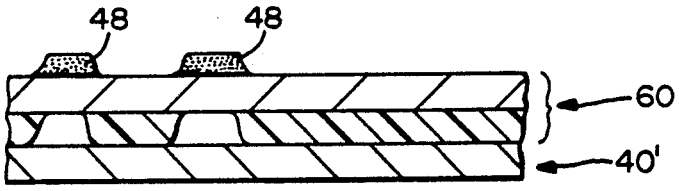
FIGs. 13A through 13D are schematic sectional views showing the steps by which the developer sheet processed as shown in FIGS. 5A through 5D can be further processed for obtaining a copy with colored and uncolored parts of the original inverted with respect to each other.
Figure 13B:
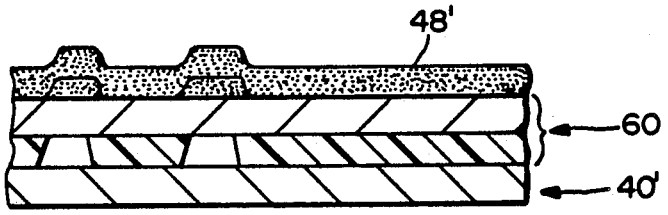
Figure 13C:
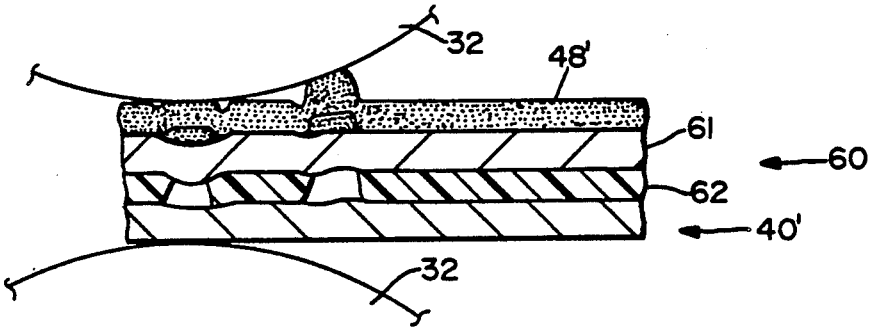
Figure 13D:
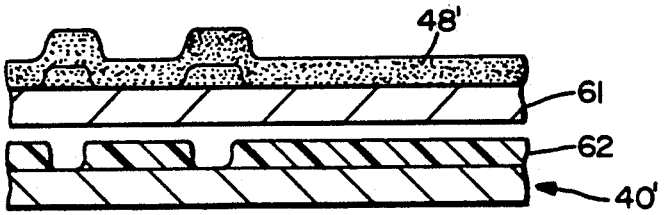

Similarly, when the developer sheet 60 of FIG. 4 is to be used, the processes explained above by way of FIGS. 5A through 5D are initially carried out. Processes to be carried out thereafter are illustrated in FIGS. 13A through 13D wherein components corresponding to those in FIGS. 5A through 5D are indicated by the same numerals and, in particular, the separation layer 63 and the adhesive layer 64 shown in FIG. 4 are again omitted for simplicity. After the copy sheet 40 of FIG. 5D is removed, a second copy sheet 40' is placed under the developer sheet 60 of FIG. 5D as shown in FIG. 13A, and the copier is run for another cycle of copying operation with a sheet having a low reflectivity placed on the document table 25 as a new original such that toner is applied all over the base sheet 61 as shown in FIG. 13B to form a new toner layer 48'. In the next step, the developer sheet 60 coated with the new toner layer 48' and the copy sheet 40' are passed between the rollers of the fixing unit 32 to be compressed a shown in FIG. 13C. This causes the color development layer 62 below the base sheet 61 to harden and to stick to the copy sheet 40' aided by the adhesive layer 64. After the developer sheet 60 and the copy sheet 40' are discharged onto the discharge tray 34, they are separated from each other as shown in FIG. 13D, and one obtains on the copy sheet 40' an image of which colored and uncolored sections of the original are inverted with respect to each other.

In summary, developer sheets of the types shown in FIGS. 2 and 4 can be used as taught above to produce an image of an original with the colored and uncolored sections inverted without using any apparatus of a complicated structure. Although a step of placing a sheet of low reflectivity on the document table 25 was disclosed above, this step can be dispensed with if the temperature of the heater 33 and the fixing unit 32 and/or the compressive force of the rollers of the fixing unit 32 is appropriately adjusted for the steps depicted in FIGs. 12C and 13C. Alternatively, use may be made of a developer sheet of a type adapted to form an image on a copy sheet placed thereunder when it is subjected to heat and/or pressure.

In all of the processes described above for producing a copy of various kinds from an original in a relatively simple manner, the initial step was to place a developer sheet 50 or 60 on top of, or under a copy sheet 40. It is extremely cumbersome, however, to make a proper pile before it is fed into a copier. If a pile is made erroneously, a copy with an inverted image may come out, for example, although an uninverted image was desired. It is therefore an additional object of the present invention to provide an image forming apparatus such as a copier capable of automatically superposing a developer sheet and a copy sheet and feeding them properly such that the cumbersome job of manually forming such piles is unnecessary and errors caused by incorrect placing of sheets can be prevented. As described below in detail by way of an example, the aforementioned object of the present invention is achieved by providing an image forming apparatus with a cassette for feeding developer sheets therefrom and another cassette for feeding copy sheets therefrom. In addition, a double feed key is provided to a control panel for activating a mechanism for supplying developer and copy sheets from these cassettes.

A copier with the capability described above is illustrated in FIG. 14 wherein components which are identical or similar to those described in connection with FIG. 1 are identified by the same numerals such as the photosensitive drum 22. Numeral 74 indicates timing rollers which are disposed on the right-hand side of the transfer charger 28 and are adapted to temporarily stop a sheet brought from a first cassette 71 or a second cassette 72 and to thereafter transport it to the part of the photosensitive drum 22 opposite to the transfer charger 28 in synchronism or at a predetermined timing with an image formed on the surface of the photosensitive drum 22.

On the left-hand side of the cassettes 71 and 72 are paper feed rollers 81 and 82, respectively. These paper feed rollers 81 and 82 are adapted to start rotating when a paper feed solenoid (hereinafter abbreviated into PF solenoid) S1 or S2 is switched on to communicate a driving force of a main motor and serve to transport a sheet in the cassette 71 or 72. In front (that is, on the paper discharging end) of the first cassette 71, there are weight rollers 73 which serve to transport a sheet supplied from the first cassette 71 to the timing rollers 74 along a guide piece 75. The guide piece 75 is provided with a paper detector sensor Ml on the right-hand side of the timing rollers 74. A sheet in the second cassette 72 and moved by the roller 82 is transported to the timing rollers 74 along another guide piece 76 provided with another paper detector sensor M2 also on the right-hand side of the timing rollers 74.

Figure 14:
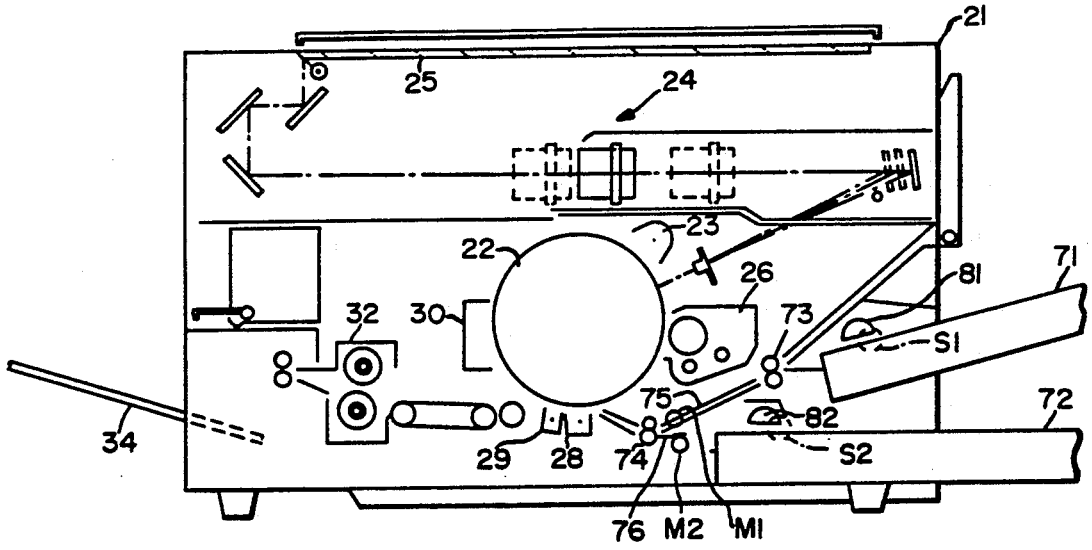
FIG. 14 is a side sectional view schematically showing the structure of another copier embodying the present invention.
Figure 15:
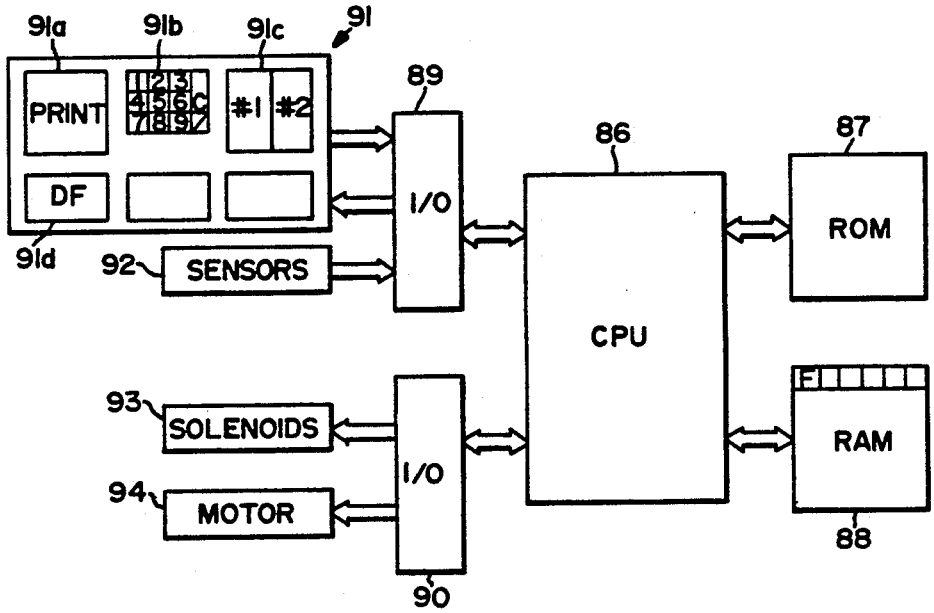
FIG. 15 is a block diagram of a control unit of the copier of FIG. 14.

FIG. 15 is a block diagram of a control unit of the copier of FIG. 14. Numeral 86 indicates a central processing unit CPU which controls the entire operation of the copier according to a program stored in a read-only memory ROM 87. Numeral 88 indicates a random-access memory RAM used as working areas when this program is executed. Numerals 89 and 90 indicate input-output ports adapted to receive ON and OFF signals from sensors 92 (such as the paper detector sensors Ml and M2) and transmit them to solenoids 93 (such as the PF solenoids S1 and S2), motors 94, etc. Numeral 91 indicates a control panel including a print switch **91*a* for sending a command to start a copying operation, numeric keys 91*b* for setting magnification, the number of copies to be made, etc., cassette selection keys 91*c* for indicating a cassette from which copy sheets are to be transported out when no developer sheets are used, and a double feed key 91*d* for feeding sheets from both the first cassette 71 and the second cassette 72 when developer sheets are used for the copying. When the methods explained above by way of FIGS. 3A through 3D and 5A through 5D, for example, are used, developer sheets of the type shown in FIG. 2 or 4 are stacked in the first cassette 71 with their color development layers 52 or 62 facing downward and copy sheets are stacked in the second cassette 72. When the methods explained above by way of FIGS. 6A through 6D and 7A through 7D, for example, are used, developer sheets of the type shown in FIG. 2 or 4 are stacked in the second cassette 72 with their color development layers 52 or 62 facing upward and copy sheets are stacked in the first cassette 71**.

Figure 16:
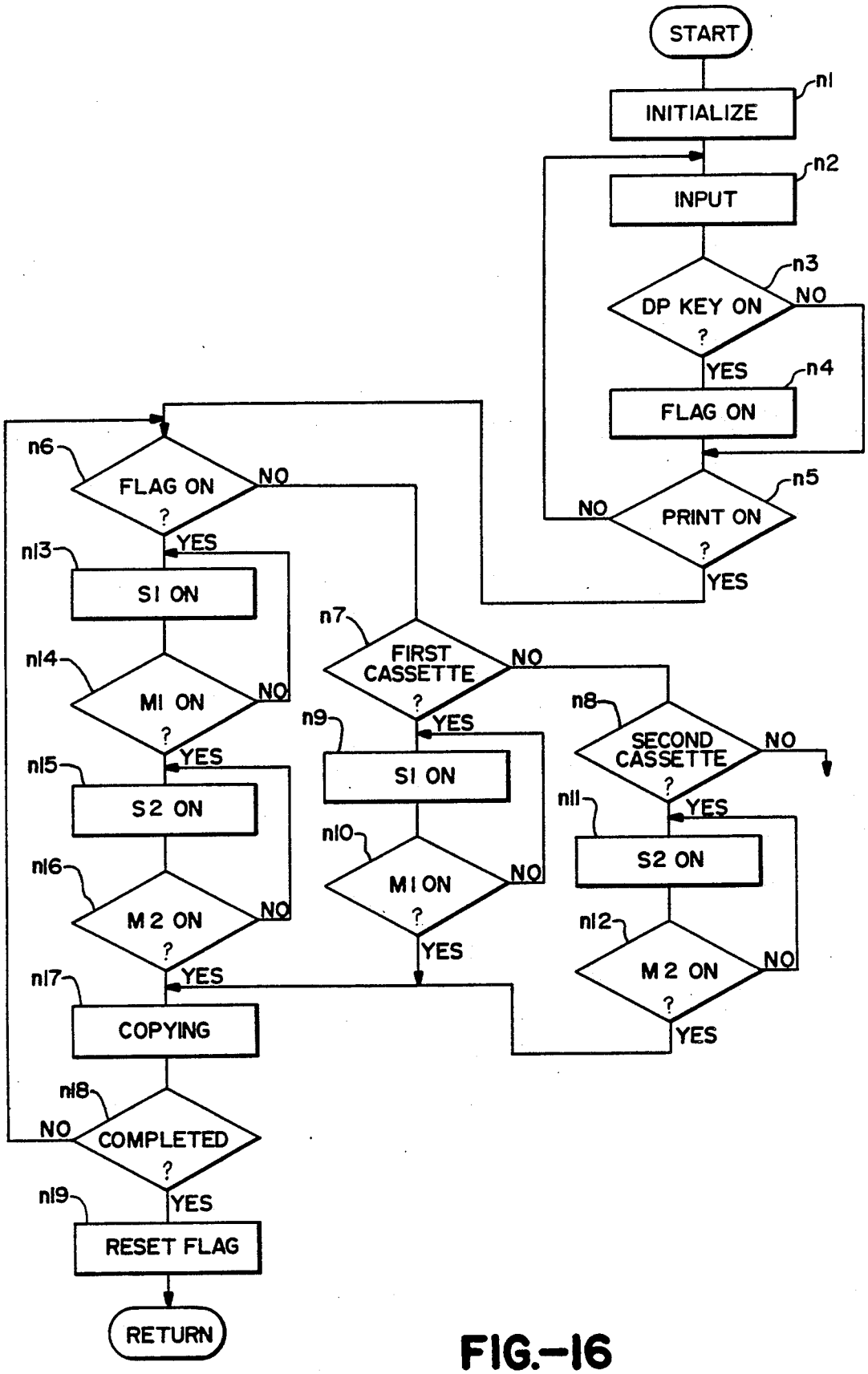
FIG. 16 is a flow chart for the operation of the copier of FIG. 14.

With reference next to FIG. 16 which is a flow chart of the operation of a copier of FIG. 14 with a control unit represented by FIG. 15, all data are initialized when power is initially switched on (n1) and input data are received next through the control panel 91 (n2). If the double feed key **91*d* is operated at this moment (YES in Step n3), a flag F indicating the double feed mode of operation is switched on (n4) inside the RAM 88. When the print switch 91*a* is subsequently turned on (YES in Step n5), one or both of the cassettes are selected according to whether the flag F is ON or OFF (n6) and sheets in the selected cassette or cassettes are transported therefrom (n7 through n16). For example, if the flag F is not on and the first cassette 71 is selected by one of the cassette selection keys 91*c* (n7), the PF solenoid S1 associated with the first cassette 71 is activated (n9), causing the paper feed roller 81 to rotate and a sheet in the first cassette 71 to be transported to the position of the timing rollers 74 by means of the weight rollers 73. The paper detector sensor Ml is switched on when the transported copy sheet reaches the position of the timing rollers 74 (n10). If the flag F is not on and the second cassette 72 is selected by the other of the cassette selection keys 91*c* (n7), the PF solenoid S2 is activated (n11) and a sheet in the second cassette 72 is transported to the position of the timing rollers 74** and the paper detector sensor M2 is switched on (n12).

If developer sheets are set in one of the cassettes 71 or 72 with copy sheets in the other and the flag F is on (n6), the PF solenoid S1 is first switched on (n13) and the Steps n9, n10, n11 and n12 described above are carried out sequentially (n14 through n16), that is, a (developer or copy) sheet in the first cassette 71 is transported to the position of the timing rollers 74 until the paper detector sensor Ml is turned on (n14) and then the second PF solenoid S2 is switched on (n15), causing another (developer or copy) sheet in the second cassette 72 to be transported to the position of the timing rollers 74 until the paper detector sensor M2 is turned on (n16). After a developer sheet and a copy sheet are thus positioned one on top of the other at the position of the timing rollers 74, a regular copying operation is carried out (n17) and any of the processes embodying the present invention described above takes place to produce a copy of the desired type. The flag F is reset (n19) after the copying operation is completed (n18). In other words, the user has only to set developer and copy sheets in correct cassettes with the correct surfaces of the developer sheets facing up. Thereafter, the copier automatically piles them correctly one sheet on top of another and feeds them together to be processed by any of the methods embodying the present invention.

The foregoing description of a preferred embodiment of the invention has been presented for purposes of illustration and description. It is not intended to be exhaustive or to limit the invention to the precise form disclosed, and many modifications and variations are possible in light of the above teaching. For example, the basic principles of the present invention described above can be combined to produce still different results. If the combination shown in FIG. 8 or 10 is used upside down as explained by way of FIGS. 6 and 7, more than one copy of inverted images can be obtained simultaneously. Any such modifications and variations that may be apparent to a person skilled in the art are intended to be included within the scope of this invention.

What is claimed is:

1. In an image forming apparatus for forming an image on a copy sheet by placing one on top of the other said copy sheet and a developer sheet having a base sheet with one surface thereof covered with a thermally fusible adhesive development layer, the improvement wherein said apparatus comprises image transfer means for applying heat, pressure or both heat and pressure to said copy and developer sheets so as to cause selected portions of said development layer to stick to said copy sheet, a plurality of sheet containers for selectively containing copy and developer sheets, stacking means capable of causing one sheet each to be delivered from said plurality of sheet containers and stacking said delivered sheets together to form a stack, and transporting means for transporting said stack to said image transfer means.

2. The apparatus of claim 1 wherein said plurality of sheet containers include a first cassette containing developer sheets and a second cassette containing copy sheets.

3. The apparatus of claim 1 further comprising a mode selection switch for selecting between a first mode of operation wherein said stacking means operates to form a stack of sheets each delivered thereby from one of said plurality of sheet containers and a second mode of operation wherein only one sheet from one of said plurality of sheet containers is delivered and said transporting means transports only said delivered sheet.

4. The apparatus of claim 3 further comprising a container selection switch for specifying one of said plurality of sheet containers from which a sheet is to be delivered by said stacking means in said second mode of operation.

5. The apparatus of claim 1 wherein said stacking means include timing rollers defining a stacking position and a feed roller associated with each of said plurality of sheet containers for transporting a sheet from said associated sheet container to said stacking position.

* * * * *